US010746495B1

(12) United States Patent
Gieseke

(10) Patent No.: US 10,746,495 B1
(45) Date of Patent: Aug. 18, 2020

(54) CATAPULT LAUNCHER

(71) Applicant: The United States of America as represented by the Secretary of the Navy, Newport, RI (US)

(72) Inventor: Thomas J Gieseke, Warren, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 16/553,205

(22) Filed: Aug. 28, 2019

(51) Int. Cl.
*F41B 4/00* (2006.01)

(52) U.S. Cl.
CPC ..... *F41B 4/00* (2013.01)

(58) Field of Classification Search
CPC ... F41B 3/00; F41B 4/00; A63B 69/40; A63B 69/406
USPC ..... 124/1, 6, 78
See application file for complete search history.

(56) References Cited

U.S. PATENT DOCUMENTS 1,611,814 A * 12/1926 Butler ..... F41B 4/00 124/78
2,379,784 A * 7/1945 Brand ..... F41A 9/30 124/6
2,413,723 A * 1/1947 Maxson ..... B64F 1/06 244/63
3,612,025 A * 10/1971 Rhodes ..... F41J 9/32 124/9
3,821,945 A * 7/1974 Foster ..... F41J 9/32 124/9
3,971,357 A * 7/1976 LaPorte ..... F41J 9/24 124/8
4,875,459 A * 10/1989 Van Elderen ..... A63F 9/02 124/49
5,819,715 A * 10/1998 Haneda ..... F41B 3/00 124/6
6,662,701 B2 * 12/2003 Grosch ..... F41B 7/00 89/1.13
6,682,054 B2 * 1/2004 Demole ..... B64F 1/08 254/283
7,712,429 B1 * 5/2010 Gibson ..... B63B 27/36 114/312
8,485,174 B2 * 7/2013 Bissonnette ..... A63B 69/406 124/1
8,613,275 B1 * 12/2013 Ogg ..... F41B 4/00 124/56
9,958,230 B1 * 5/2018 Nugent ..... F41B 4/00
9,994,335 B1 * 6/2018 Been ..... B64F 1/06
10,118,713 B2 * 11/2018 Tully ..... B64F 1/08
(Continued)

*Primary Examiner* — Alexander R Niconovich
(74) *Attorney, Agent, or Firm* — James M. Kasischke; Michael P. Stanley

(57) ABSTRACT

An impulse launcher is provided with a motor to store rotational kinetic energy in a flywheel. The stored kinetic energy is released using a planetary gear transmission that links the flywheel to a drive shaft. The kinetic energy is released when the planetary gear carrier is decelerated using a brake. The planetary gear carrier deceleration forces rotational acceleration of the drive shaft and deceleration of the flywheel. The drive shaft turns a primary drive sprocket and a secondary drive sprocket which pulls a studded drive belt which in turn drives a projectile located between the studded belt and a guide. The planetary gear system and belt drive allow rapid transfer of energy from the flywheel to a projectile.

2 Claims, 5 Drawing Sheets

(56) References Cited

U.S. PATENT DOCUMENTS

2011/0163503 A1* 7/2011 Townsend ..... F41J 5/18
273/355

* cited by examiner

CATAPULT LAUNCHER

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention relates to a mechanical launcher of high speed vehicles and projectiles.

(2) Description of the Prior Art

Launchers can impart kinetic energy to stationary objects. The launchers require a source of energy and an ability to convert that energy into the linear motion of a launch body or projectile. The launchers are required to accelerate projectiles or high speed vehicles from a position of rest to high velocity movement.

Launch systems that use chemical energy or compressed air present energy storage, safety and environment problems. A superior alternative is to provide a mechanical system that can produce an adjustable launch acceleration profile and that can be easily adapted to an expanded range of vehicle sizes and launch speeds.

Mechanical launchers are well known in the art. Some launchers use the storage of energy in springs that can produce motion that is similar to a projectile from a bow. Other launchers, such as catapults, use the potential energy of elevated weights to actuate "throwing arms".

Yet another class of launchers use rotating tires separated by a small gap to grip and propel projectiles. When a projectile enters the gap between the tires; the projectile rapidly accelerates to the speed of the rotating tire surface. Kinetic energy of the tire is transferred to the projectile during the launch.

This type of launcher is commonly used in baseball pitching machines. The launcher offers the advantage over other types of launchers that the launcher can be easily and repeatedly energized, loaded, and fired. This type of launcher is also mechanically simple.

However, operation of this type of launcher can be problematic. First, the acceleration of the projectile is rapid. The projectile accelerates from a rest position to the circumferential speed of the tires during a few degrees of rotation of the tires. This rapid acceleration causes significant acceleration loads on the projectile and large torsional loads on the hub of the launch tires.

Typically, the associated shock load is mitigated through the flexure of the tires as the projectile is accelerated. This acceleration is not a problem for inert objects like baseballs but can cause damage to bodies that have onboard electronics or are otherwise fragile.

The second problem is that the rotational kinetic energy of the tires must be larger than the intended launch energy of the projectile. If the rotational energy of the tires is not large enough; then the tires would decelerate excessively through the transfer of energy to the projectile and the final velocity of the projectile would be low.

Based on the shortcomings of the prior art, an apparatus is needed that uses the rotational kinetic motion of a flywheel as a source of stored energy but can extract that energy in a controlled manner to provide moderate impulse loads on the projectile. The apparatus should also be capable of transferring a large percentage of the stored kinetic energy to the projectile during the launch process.

SUMMARY OF THE INVENTION

It is therefore a general purpose and primary object of the present invention to provide an apparatus for launching a projectile or vehicle from an at rest position to a predetermined velocity.

It is a further object of the present invention to transfer energy from an energy source to a projectile or vehicle through a controllable energy transfer profile.

It is a still further object of the present invention to impart a linear velocity to a projectile or vehicle that exceeds a circumferential velocity at the surface of a flywheel.

Other objects and advantages of the present invention will be apparent from the following description where a mechanical launcher is provided.

In one embodiment of the present invention, the launcher comprises a drive gear and idler gear in a common plane with rotational axes separated by a distance. A drive belt surrounds and connects the drive gear and the idler gear with the drive belt parallel to a guide.

A projectile is initially held between the drive belt and the guide using protrusions on the drive belt mating with matching recesses in the projectile. The guide supports the projectile prior to and during launch and also maintains alignment between the drive belt and the projectile during the launch process.

The drive gear is connected to an output shaft of a differential planetary gear transmission. The ring gear of the planetary gear transmission is connected to a flywheel and the carrier gear assembly of the differential planetary gear transmission is connected to a disk brake. A drive motor is also connected to the flywheel.

In preparation for launch, the flywheel, the carrier gear assembly and planetary gears are accelerated to store kinetic energy. At launch, energy is transferred from the flywheel to the projectile by actuating the carrier gear assembly brake caliper, and squeezing the brake caliper onto the carrier gear assembly. Force applied to the carrier gear assembly and transferred to the planetary gear hubs is equally transmitted to decelerate the flywheel and to accelerate the drive gear. The projectile is accelerated as the drive belt is accelerated by the drive gear.

By adjusting the force with which the brake is actuated, the force transferred through the transmission to the projectile is controlled. As such, the present invention transfers rotational kinetic energy of a flywheel thru a differential planetary gear transmission to a drive belt. The drive belt imparts linear kinetic energy to a projectile.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Systems and techniques exist for launching a projectile from an at rest position. The present invention is in this category of device but employs a novel set and arrangement of components. These components allow a projectile to be accelerated from the rest position by following a controlled acceleration profile.

Figure 1:
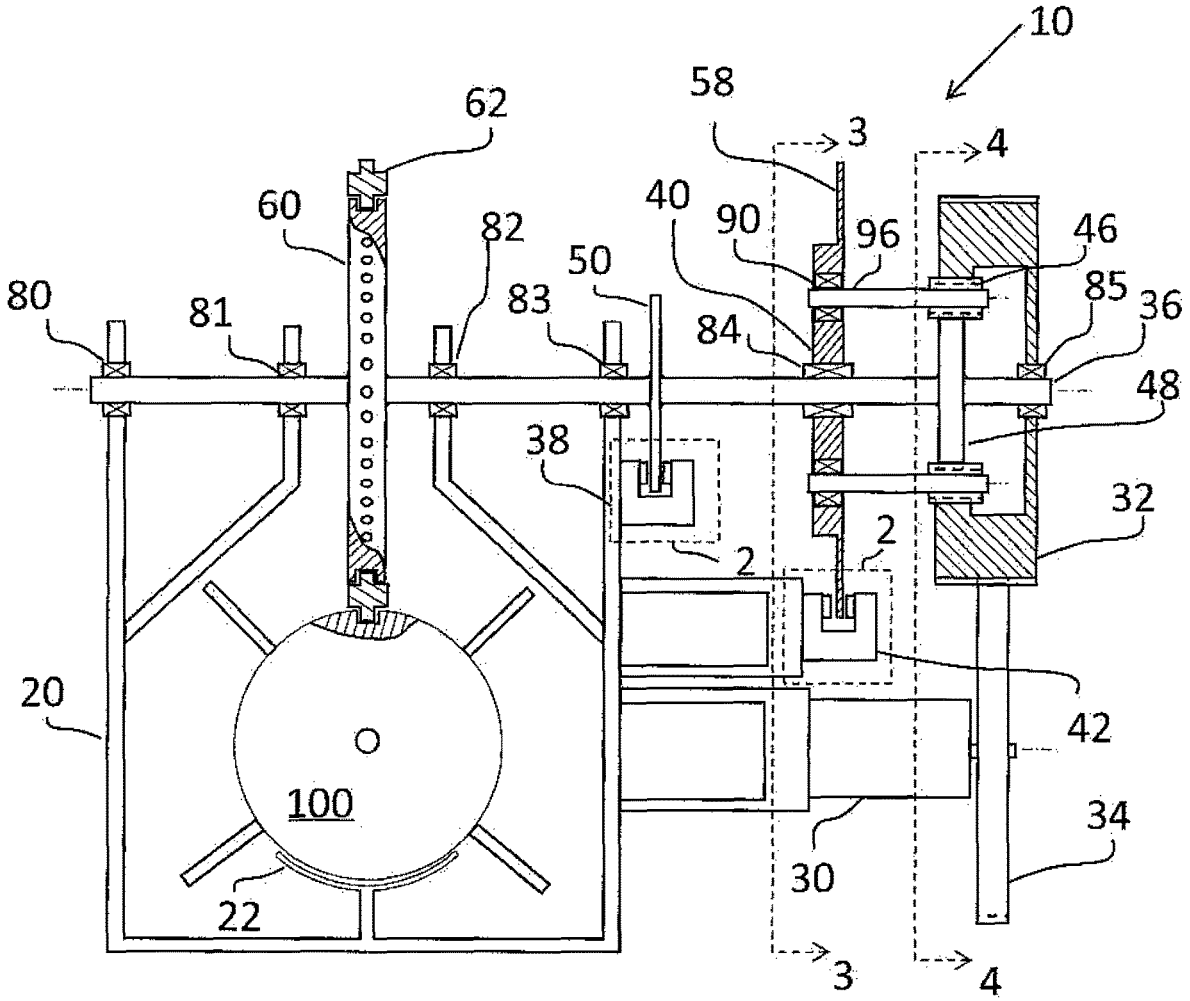
FIG. 1 depicts a launcher system of the present invention as viewed along an axis of a projectile secured for launch.

FIG. 1 depicts a launcher system 10 of the present invention viewed along an axis of a projectile 100. A frame structure 20 includes a cradle 22 which supports the projectile 100 prior to launch. A drive motor 30 is attached to the frame structure 20.

To energize the system, a ring gear 32 is accelerated from the rest position by the drive motor 30 via a drive gear 34. The ring gear 32 is co-axial with a drive shaft 36 and is allowed to rotate via a central axis of the drive shaft by a bearing 85. The drive gear 34 between the drive motor 30 and the ring gear 32 can be replaced with any suitable linkage mechanism including belt drives. The combination of the drive gear 34 and the ring gear 32 serve as a flywheel system that stores rotational kinetic energy as both are accelerated to a high speed.

During this energy storage phase of the launch cycle, the drive shaft 36 is kept from rotating by a drive shaft brake caliper 38, which clamps and holds a drive shaft brake disk 50 in place. The drive shaft brake disk 50 is constructed from an electrically conductive material. The drive shaft brake caliper 38 is mounted to the frame structure 20.

Also, during this energy storage phase, a carrier gear assembly 40 is allowed to rotate by disengaging a carrier assembly brake caliper 42 from a carrier assembly brake disk 58. The carrier assembly brake disk 58 is an annular extension of the carrier gear assembly 40. The carrier assembly brake disk 58 is constructed from an electrically conductive material. The carrier assembly brake caliper 42 would, if activated, squeeze the carrier assembly brake disk 58. The carrier assembly brake caliper 42 is mounted to the frame structure 20.

Figure 2:
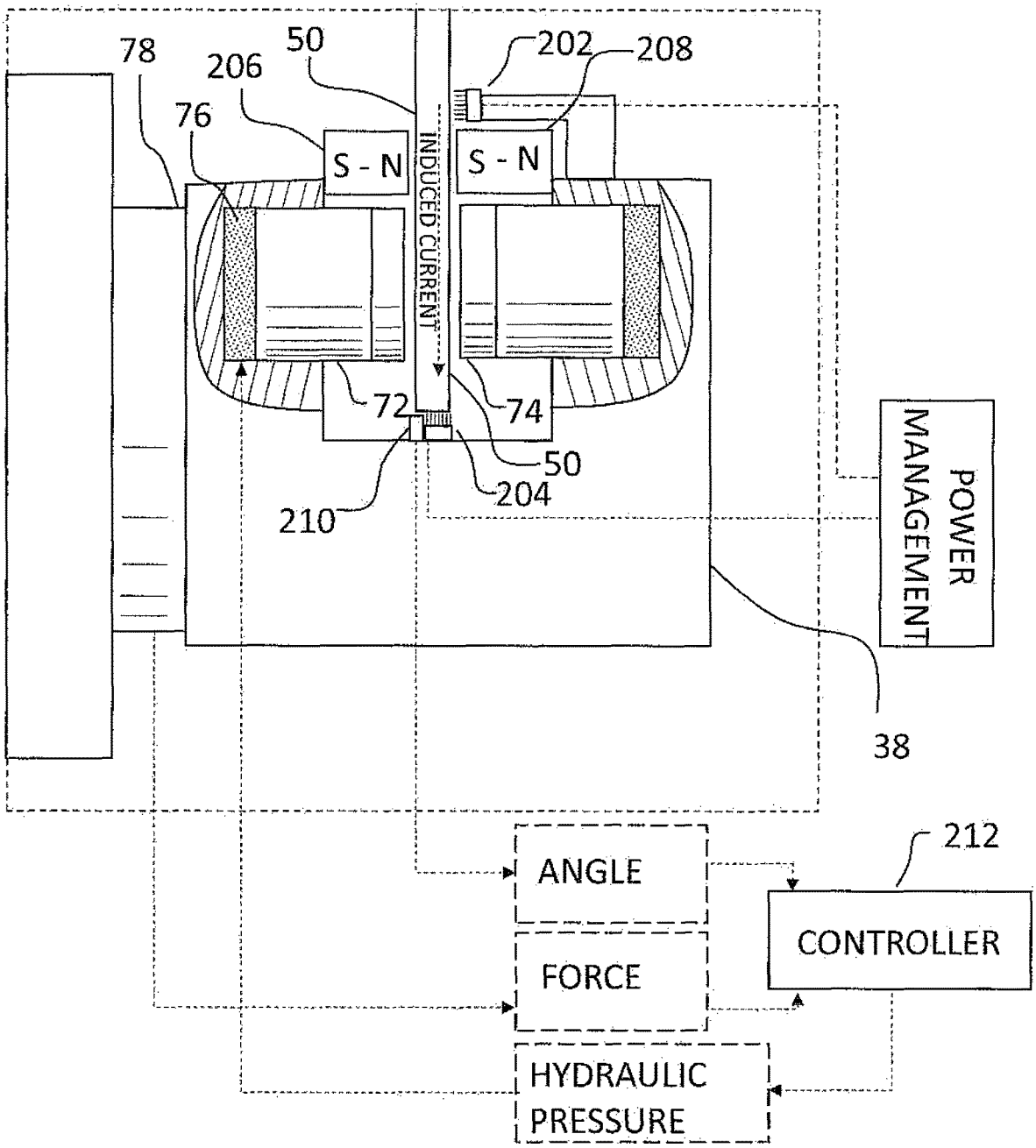
FIG. 2 depicts a view of a brake assembly of the launcher system.

FIG. 2 depicts details of the drive shaft brake caliper 38. The drive shaft brake caliper 38 includes hydraulic pistons 72 actuated through pressurization of hydraulic fluid 76. When actuated, the hydraulic pistons 72 press friction pads 74 against the surface of the primary shaft brake disk 50. Friction occurs at the interface between the brake pad 74 and the drive shaft brake disk 50.

The drive shaft brake caliper 38 includes the necessary elements to form an inductive brake system to assist in braking of the drive shaft 36 and to recover kinetic energy in the form of electrical energy. The inductive brake is a Faraday disk design, which is well known in the art. A magnetic field is created across the drive shaft brake disk 50 using permanent magnets, 206 and 208, with poles oriented to create field lines passing through the brake disk 50.

Movement of the drive shaft brake disk 50 creates an induced current through the drive shaft brake disk. Brush contacts at a rim 204 of the drive shaft brake disk and near the hub of drive shaft brake disk lead via electrical connections 202 to a power management system and complete an electrical circuit. Motion of the drive shaft brake disk 50 is resisted as a result of the induced current and the electrical load in the power management system.

Brake calipers and induction brakes of this type are well known in the art. The discussion above also applies to the carrier assembly brake caliper 42 and the carrier assembly brake disk 58. The carrier assembly brake caliper 42 is not shown in detail. However, the carrier assembly brake caliper 42 is identical in design to the drive shaft brake caliper 38.

Figure 3:
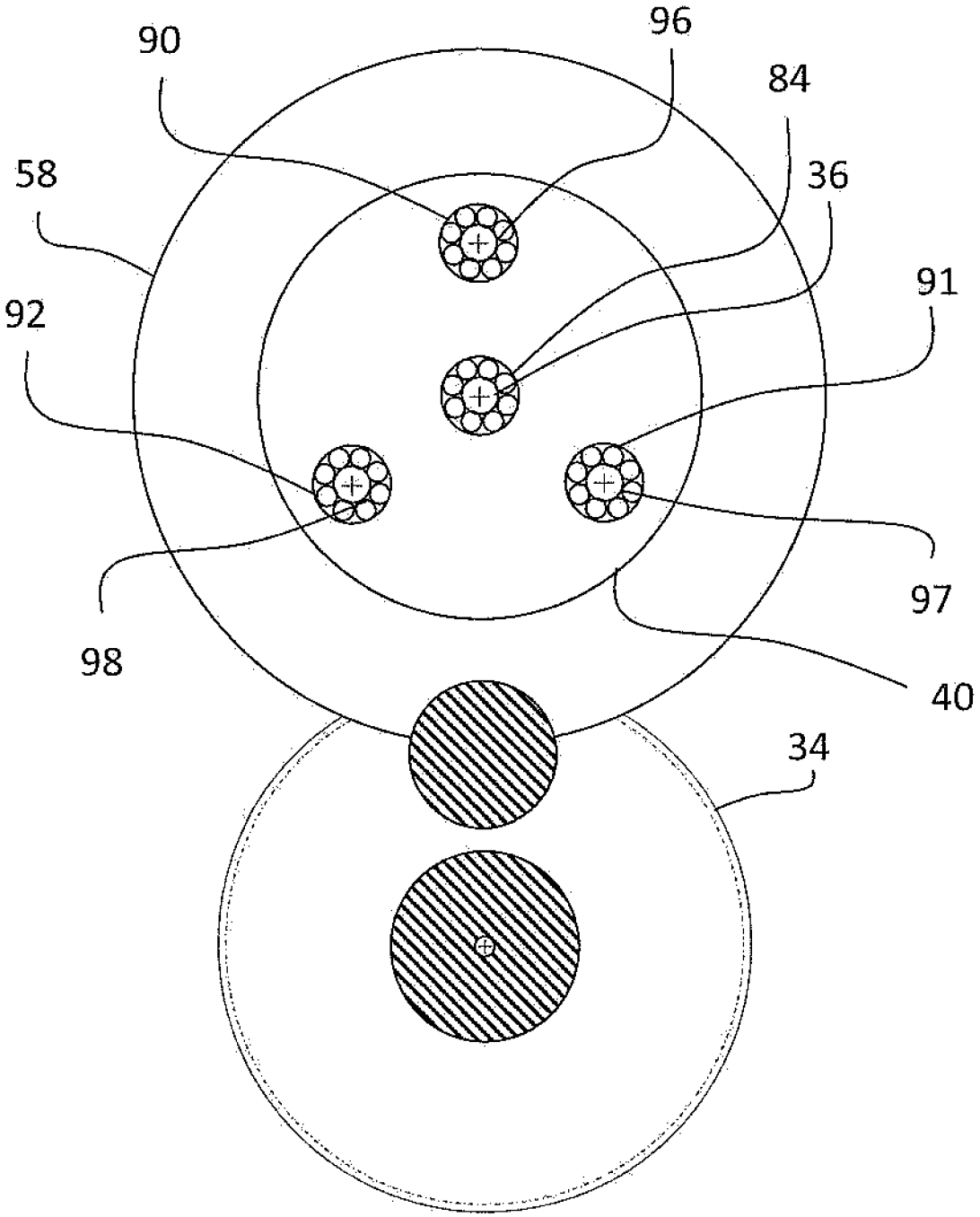
FIG. 3 depicts a sectional view of gears of the launcher system.

As depicted in FIG. 1, the carrier gear assembly 40 is mounted co-axially to the drive shaft 36 via the bearings 84 to allow independent relative rotation of the drive shaft and the carrier gear assembly. As depicted in FIG. 3, planetary gear shafts 96, 97, and 98 and associated bearings 90, 91, and 92 are at three or more locations around the body of the carrier gear assembly 40 and at a common radius relative to the center of the drive shaft 36.

Planetary gears 46 are free to rotate about axes passing through their centers. These axes are perpendicular to the face of the carrier gear assembly 40. The planetary gear shafts 96, 97, and 98 support and connect the planetary gears 46 to the carrier gear assembly 40. The planetary gear bearings 90, 91, and 92 allow the planetary gear shafts 96, 97, and 98 to rotate freely.

Figure 4:
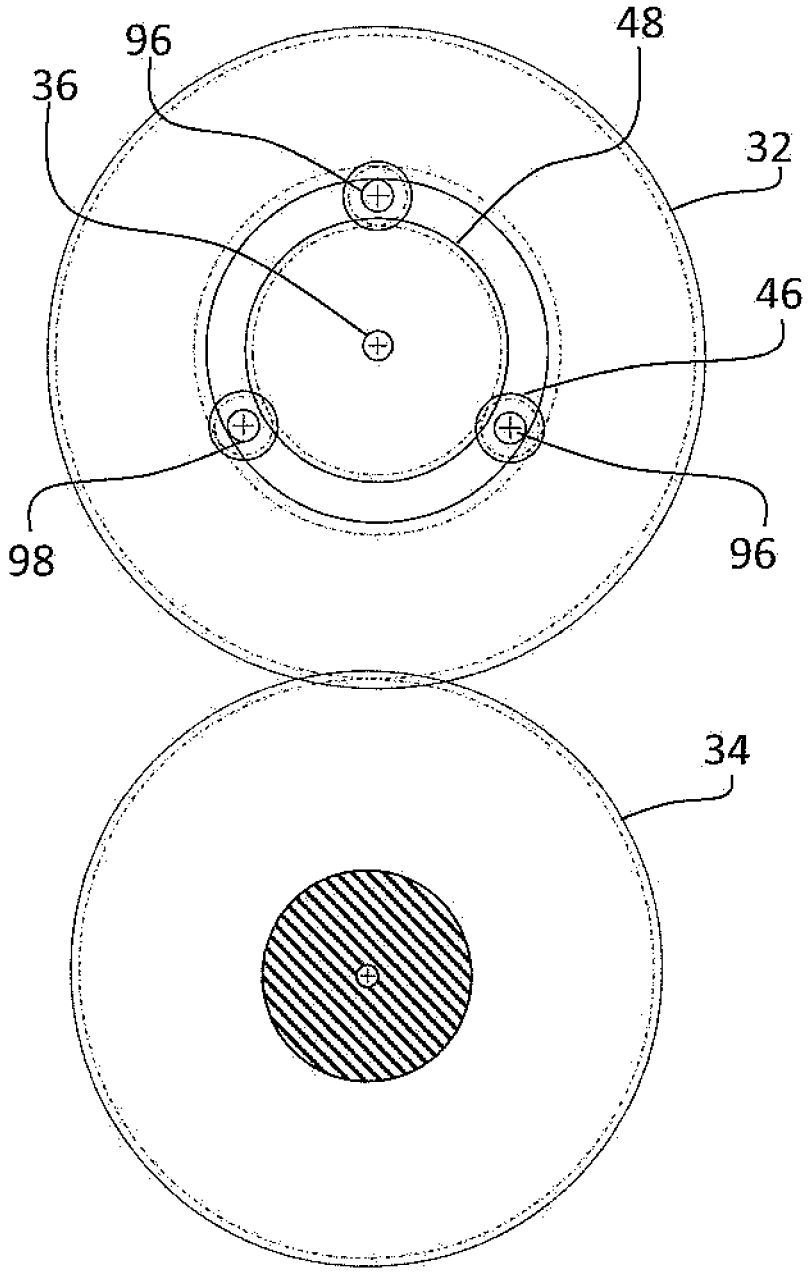
FIG. 4 depicts a sectional view of the launcher system of the present invention showing aspects of a planetary gear system.

As depicted in FIG. 4, the planetary gears 46 connect the ring gear 32 and a sun gear 48 via teeth on an outer diameter of the sun gear and on an inner diameter of the ring gear. Relative rotational motion of the ring gear 32 and the sun gear 48 is achieved via rotation of the planetary gears 46. Rotational motion of the carrier gear assembly 40 (shown in FIG. 3) is coupled to the rotational motion of the sun gear 48 and the ring gear 32.

The sun gear 48, the ring gear 32, the carrier gear assembly 40 and the planetary gears 46 form a gear structure commonly known as a planetary gear differential. These gear systems are well known in the art. A planetary gear differential has known kinematic characteristics. The most relevant characteristic to the present invention is that the carrier gear assembly 40 will rotate to an angle equal to a proportional sum of an angle of rotation of the ring gear 32 and an angle of rotation of the sun gear 48.

Returning to FIG. 1, acceleration of the drive shaft 36 is controlled by applying an external torque to the carrier gear assembly 40 via the carrier assembly brake caliper 42. When the ring gear 32 is accelerated to the desired high speed and the drive shaft 36 is held stationary; the carrier gear assembly 40 will accelerate to a rotational speed governed by the gear ratios of the ring gear 32, the sun gear 48 and the planetary gears 46.

The launch process is initiated by releasing the drive shaft brake caliper 38 and applying a force to the carrier gear assembly 40 via the carrier assembly brake disk 58 by activating the carrier assembly brake caliper 42 and drawing current through a power management system. The power management system would be a typical power management system and would be known to those ordinarily skilled in the art.

The applied force is transmitted via the planetary gears 46 to decelerate the ring gear 32 and accelerate the drive shaft 36. The drive shaft 36 rotates relative the frame structure 20 by a plurality of roller bearings (80, 81, 82, and 83).

Figure 5:
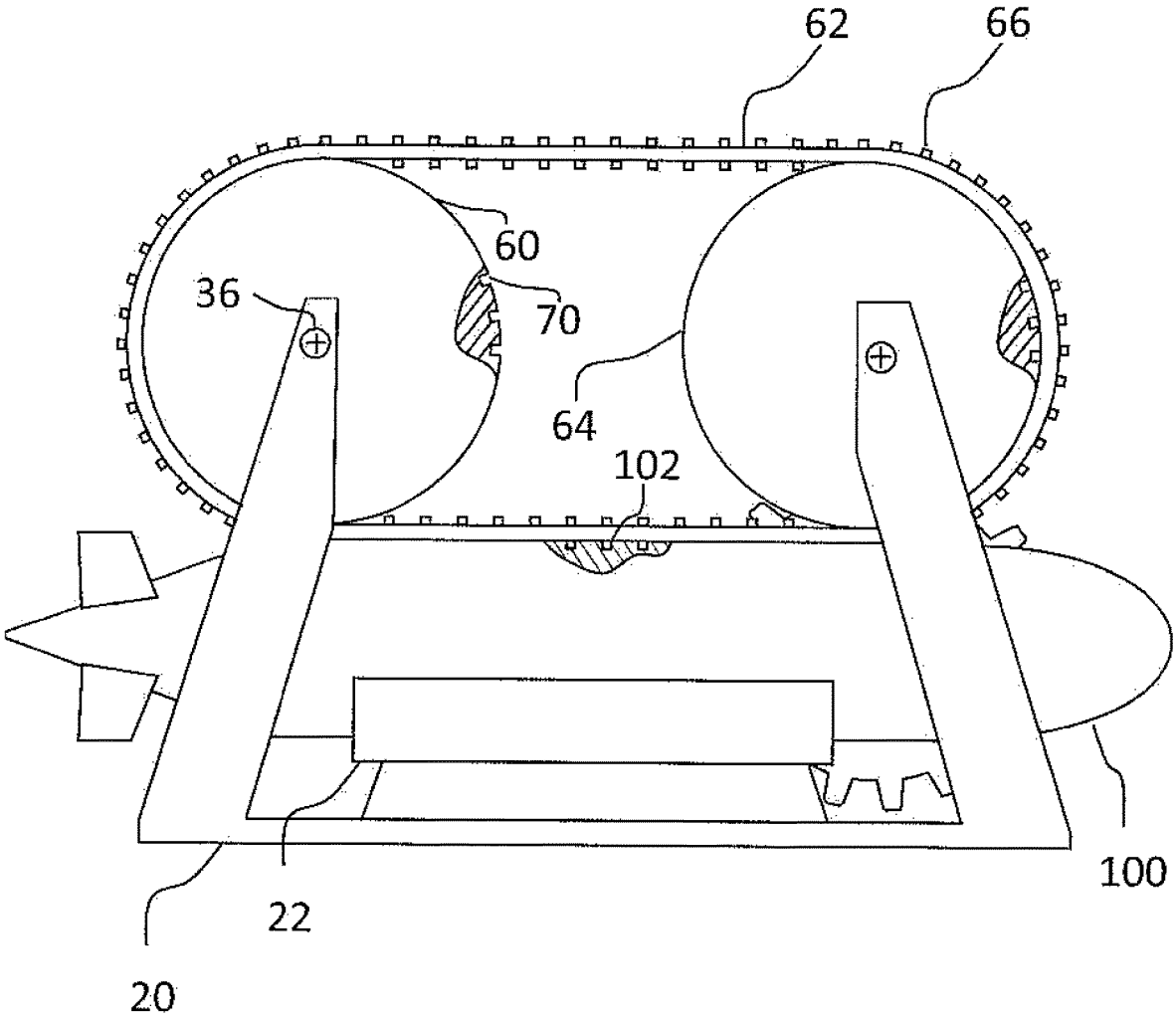
FIG. 5 depicts a side view of the launcher system of the present invention.

As depicted in FIG. 5, a primary drive sprocket 60 is coaxially attached to the drive shaft 36. A studded belt 62 passes around the periphery of the primary drive sprocket 60 to a secondary drive sprocket 64.

Both the primary drive sprocket 60 and the secondary drive sprocket 64 are attached to the frame structure 20 to allow rotation about their central axes. Studs 66 on the studded belt 62 mate via recesses 70 in the primary drive sprocket 60 and the secondary drive sprocket 64.

The projectile 100 includes recesses 102 along an upper surface to provide a slip-free mating with the studded belt 62. The primary drive sprocket 60, the secondary drive sprocket 64 and the studded belt 62 form a linkage between the drive shaft 36 and the projectile 100 through the recesses 102 in the surface of the projectile. Rotation acceleration of the drive shaft 36 is converted into linear acceleration of the projectile 100.

The projectile 100 slides along the cradle 22 during this acceleration. Through this energy transfer process, the velocity of the projectile 100 can exceed the linear velocity of a rim of the ring gear 32 or the drive gear 34 provided that the total system energy is conserved. This includes the loss of heat at the carrier assembly brake disk 58 and energy stored in the power management electronics.

When the projectile 100 has moved off the cradle 22 and the launch process has been completed; the carrier assembly brake caliper 42 is released. The drive shaft brake caliper 38 is actuated to bring the drive shaft 36 to rest. Kinetic energy in the drive shaft 36 and other moving parts is converted to electrical energy using the induction current system and power management system associated with the drive shaft brake caliper 38.

A new projectile 100 is loaded on the cradle 22 by a gradual actuation of the carrier assembly brake caliper 42 and partial release of the drive shaft brake caliper 38 to force a slow rotation of the primary drive sprocket 60.

To control a launcher acceleration profile, the force applied via the carrier assembly brake caliper 42 is controlled via the launch process using a controller 212 and monitored using a load sensor 78. A closed loop control system 212 is implemented by comparing a desired acceleration of the drive shaft 36 to the actual acceleration. The actual acceleration is measured using index marks on a drive shaft brake disk 50 observed using an optical sensor 210 integral to or co-located with the drive shaft brake caliper 38.

The comparison produces an error signal that is scaled and applied as a force to the carrier gear assembly 40 by the carrier assembly brake caliper 42 by adjusting the pressure of the hydraulic fluid 76. Systems for applying pressurized hydraulic fluid are well known in the art.

The actuation force applied by the carrier assembly brake caliper 42 is adjusted using well known proportional-integral-differential control strategies in the controller 212 to match the desired acceleration of the drive shaft 36 to the measured acceleration of the drive shaft as the secondary drive sprocket 64 rotates and the projectile 100 accelerates.

The projectile 100 is launched when the projectile advances forward of the cradle 22 and disengages from the studded belt 62. At this point in the launch process, there is no longer any contact between the catapult launcher 10 and the projectile 100.

It will be understood that many additional changes in the details, materials, steps and arrangement of parts, which have been herein described and illustrated in order to explain the nature of the invention, may be made by those skilled in the art within the principle and scope of the expressed in the appended claims.

What is claimed is:

1. A launcher for accelerating and launching a projectile from a cradle, said launcher comprising:

a frame with a horizontal planar base having a plurality of vertical plates extending therefrom;

a drive motor affixed to a face of a first vertical plate of said plurality of vertical plates, said drive motor having a drive motor shaft with an axis of rotation parallel to said base;

a drive gear with teeth on an outer rim, said drive gear coaxially attached to an end of said drive motor shaft wherein said drive gear is capable of rotation at a predetermined speed;

a drive shaft offset from said drive motor shaft, said drive shaft surrounded by a first set of bearings positioned through said vertical plates of said frame;

a drive shaft brake disk with indexed circumferential marks, said drive shaft brake disk positioned coaxial to and rotationally secured to said drive shaft with said drive shaft brake disk longitudinally positioned along said drive shaft outside of and offset from said frame;

a sun gear coaxially secured to said drive shaft, said sun gear having teeth on an outer rim with positioning along said drive shaft between said drive shaft brake disk and a first end of drive shaft opposite said vertical plates of said frame;

a ring gear coaxially secured to said drive shaft with a second set of bearings and said drive shaft at the first end of said drive shaft and co-planar to said drive gear with said ring gear having a first set of gear teeth on an outer surface to mate with the teeth of said drive gear, said ring gear having an internal volume facing away from the first end of said drive shaft with the internal volume having a second set of gear teeth around an inner surface;

a plurality of planetary gears, each of said planetary gears having a central aperture, said planetary gears distributed circumferentially in an annular space between said sun gear and said ring gear at a same position along a longitudinal axis of said sun gear, each of said planetary gears having a diameter equal to a difference in radii of an internal volume of said ring gear and an outer radius of said sun gear with teeth on an outer rim to simultaneously mate with said ring gear and said sun gear;

a carrier gear assembly with an annular extension forming a circumferential carrier assembly brake disk, said carrier gear assembly coaxially positioned and secured to said drive shaft with a third set of bearings, said carrier gear assembly longitudinally positioned along said drive shaft between drive shaft brake disk and said ring gear with said carrier assembly brake disk having multiple attachment points circumferentially at a radial offset equal to an average radius of an outer radius of said sun gear and an inner radius of said ring gear;

a plurality of planetary gear shafts, each of said planetary gear shafts rigidly attached perpendicular to a surface of said carrier gear assembly at each of the multiple attachment points with each of said planetary gear shafts supporting each of said planetary gears;

a plurality of planetary gear bearings, each of said planetary gear bearings positioned in each of the central apertures of said planetary gears to allow rotation of said planetary gears about said planetary gear shafts;

a drive shaft brake caliper including a hydraulic cylinder, said drive shaft brake caliper bracketing said drive shaft brake disk such that when said drive shaft brake caliper is actuated, a restraining force is applied by said hydraulic cylinder to said drive shaft brake disk and onto said drive shaft;

a sensor attached to said drive shaft brake caliper and in proximity to said drive shaft brake disk with said sensor capable of detecting the indexed circumferential marks of said drive shaft brake disk;

a carrier assembly brake caliper including a hydraulic cylinder, said carrier assembly brake caliper attached to said frame such that when said carrier assembly brake caliper is actuated, a restraining force is applied by said hydraulic cylinder to said carrier gear assembly;

a load sensor integral to an interface between said carrier assembly brake caliper and said frame with said load sensor capable of sensing forces applied by said carrier assembly brake disk;

a primary drive sprocket positioned coaxially to said drive shaft with said primary drive sprocket rigidly rotationally and longitudinally secured to said drive shaft and with said primary drive sprocket aligned with the centerline of said frame and having a plurality of recesses uniformly spaced around a circumference of said primary drive sprocket;

a secondary drive sprocket with an axis of rotation parallel to said primary drive sprocket at a location displaced horizontally relative to said base and in a rotational plane of said primary drive sprocket, said secondary drive sprocket having an integral shaft through an axis of rotation with said integral shaft passing through a fourth set of bearings in said frame and said secondary drive sprocket having a plurality of recesses uniformly spaced around a circumference of said secondary drive sprocket;

a drive belt having uniformly distributed studs along an inner and outer surface, said studs placed at a spacing equal to the spacing around said primary drive sprocket and said secondary drive sprocket with said studs having a size and shape matching the size and shape of the recesses in said primary drive sprocket and said secondary drive sprocket; and a guide rigidly attached to said base with a centerline longitudinal dimension positioned in a plane containing said primary drive sprocket and said secondary drive sprocket with said guide capable of positioning the projectile such that a longitudinal axis of the projectile is positioned in the plane containing said primary drive sprocket and said secondary drive sprocket;

wherein said drive motor is capable of accelerating said ring gear to a predetermined speed as said drive shaft is held stationary such that energy is stored in said ring gear as rotational kinetic energy;

wherein said rotational kinetic energy is transferred to said primary draft shaft as an accelerating torque and rotational motion from said ring gear when a force is applied to said carrier gear assembly by said carrier assembly brake caliper;

wherein rotating said drive shaft in a first direction results in movement of said drive belt and the projectile along the longitudinal axis of said guide with the projectile being launched when the projectile advances forward of the cradle and disengages from said studs.

2. A method to launch a projectile, said method comprising the steps of:

providing a catapult launcher;

providing a projectile;

providing a desired projectile acceleration profile as a function of displacement of the projectile within the catapult launcher;

calculating a caliper actuation force required to achieve the acceleration profile;

placing the projectile between a cradle of the catapult launcher and a catapult launcher studded belt with drive belt studs mated to recesses in the projectile;

actuating a drive shaft brake caliper;

releasing a carrier assembly brake caliper;

accelerating a drive motor;

storing kinetic energy as rotational motion of a ring gear;

releasing the drive shaft brake caliper;

measuring an instantaneous rotation of a drive shaft using index marks observed on a drive shaft brake disk using an optical sensor;

calculating a rotational acceleration of the drive shaft as a derivative of a drive shaft rotation rate;

calculating a difference of a desired rotational acceleration of the drive shaft and an actual rotational acceleration of the drive shaft to produce an error signal;

applying a proportional-integral-differential control algorithm to the error signal to produce a hydraulic fluid pressure command;

applying the pressure command to the carrier assembly brake caliper hydraulic fluid to squeeze friction pads against a surface of a carrier assembly brake disk;

connecting an induced current output from Faraday disk components of an electrical energy storage element in a power management system;

adjusting the pressure command applied by the carrier assembly brake caliper as the projectile accelerates;

releasing the carrier assembly brake caliper;

connecting the induced current output from the Faraday disk components of the drive shaft brake caliper to an electrical energy storage element in the power management system to apply an induced deceleration load on the drive shaft brake disk and extract kinetic energy stored in the catapult launcher as electrical energy; and applying a force to the drive shaft brake disk by the drive shaft brake caliper to complete deceleration of the drive shaft, a drive sprocket, and a drive belt.

* * * * *